US009479861B2

(12) United States Patent
Bisset et al.

(10) Patent No.: US 9,479,861 B2
(45) Date of Patent: Oct. 25, 2016

(54) COMPACT WIDEBAND BASS AND MIDRANGE HORN-LOADED SPEAKER SYSTEM

(71) Applicants: Anthony Allen Bisset, Oakland, CA (US); Quang-Viet Nguyen, Aldie, VA (US)

(72) Inventors: Anthony Allen Bisset, Oakland, CA (US); Quang-Viet Nguyen, Aldie, VA (US)

( * ) Notice: Subject to any disclaimer, the term of this patent is extended or adjusted under 35 U.S.C. 154(b) by 40 days.

(21) Appl. No.: 14/316,221

(22) Filed: Jun. 26, 2014

(65) Prior Publication Data

US 2015/0382090 A1 Dec. 31, 2015

(51) Int. Cl.

| | |
|---|---|
| ***H04R 1/02*** | (2006.01) |
| ***H04R 1/28*** | (2006.01) |
| ***H04R 1/30*** | (2006.01) |
| *H04R 27/00* | (2006.01) |

(52) U.S. Cl.

CPC ..... *H04R 1/2819* (2013.01); *H04R 1/2842* (2013.01); *H04R 1/2857* (2013.01); *H04R 1/2865* (2013.01); *H04R 1/30* (2013.01); *H04R 1/021* (2013.01); *H04R 1/025* (2013.01); *H04R 1/2811* (2013.01); *H04R 27/00* (2013.01)

(58) Field of Classification Search

CPC .... H04R 1/021; H04R 1/025; H04R 1/2857; H04R 1/30; H04R 1/2811; H04R 27/00; H04R 1/2819; H04R 1/2842; H04R 1/2865

USPC ..... 381/386

See application file for complete search history.

(56) References Cited

U.S. PATENT DOCUMENTS

| | | | | |
|---|---|---|---|---|
| 2,224,919 | A | 12/1940 | Olson | |
| 2,604,182 | A | 7/1952 | Massa | |
| 3,047,090 | A | 7/1962 | Pruden | |
| 3,356,179 | A | 12/1967 | Tompkins | |
| 3,912,866 | A | 10/1975 | Fox | |
| 4,314,620 | A | 2/1982 | Gollehon | |
| 5,012,889 | A | 5/1991 | Rodgers | |
| 5,140,641 | A * | 8/1992 | Danley | G10K 7/04 340/404.3 |
| 5,177,329 | A | 1/1993 | Klayman | |
| 5,197,103 | A | 3/1993 | Hayakawa | |
| 5,266,751 | A | 11/1993 | Taguchi | |
| 5,825,900 | A * | 10/1998 | Jeon | H04R 5/02 181/152 |
| 6,431,309 | B1 * | 8/2002 | Coffin | H04R 1/2819 181/145 |
| 8,457,341 | B2 | 6/2013 | Danley | |

FOREIGN PATENT DOCUMENTS

| | | | |
|---|---|---|---|
| EP | 0 217 278 | A2 | 4/1987 |
| JP | 2013219728 | A | 10/2013 |
| WO | 2007109075 | A2 | 9/2007 |

* cited by examiner

*Primary Examiner* — Duc Nguyen
*Assistant Examiner* — Sean H Nguyen
(74) *Attorney, Agent, or Firm* — Hudak, Shunk & Farine Co. LPA

(57) ABSTRACT

The invention is a compact high fidelity sound reproduction system achieving high efficiency, low distortion, wide bandwidth, and extended low frequency reach and which can be used as a sub-bass woofer, bass woofer, mid-bass woofer, and mid-range speaker for residential or commercial large venue applications. The system includes a dynamic driver driven bass horn, a looped resonator duct (ring geometry), which can be folded, and an adjustable feedback duct allowing sound characteristics to be tailored.

30 Claims, 20 Drawing Sheets

Simplified Schematic Topology Diagram for Present Invention

Schematic Diagram of Present Invention Reduced to Practice

Simplified Schematic Topology Diagram for Present Invention

Predicted Frequency Response and Impedance for Present Invention

Schematic Topology Diagram for Bass Horn Prior Art

Predicted Frequency Response and Impedance for Bass Horn

Schematic Topology Diagram for Tapped Horn Prior Art

Predicted Frequency Response and Impedance for Tapped Horn

Schematic of Central-Mouth Bass Horn with Ring Resonator and Feedback Duct

Schematic of Circular Bass Horn with Ring Resonator and Feedback Duct

Schematic of Switchable Path Bass Horn with Ring Resonator and Feedback Duct

Schematic of Transverse Bass Horn with Ring Resonator and Feedback Duct

Schematic of Coaxial Horn with Ring Resonator and Feedback Duct(s)

Schematic of Moebius Bass Horn with Ring Resonator and Feedback Duct

Comparison of Measurement and Model

Measured Electrical Impedance and Phase of Present Invention

Predicted Frequency Response and Impedance of a Infrasonic Subwoofer Example

Predicted Frequency Response of a Wide-bandwidth Subwoofer Example

Measured Frequency Response and Distortion at 1 meter

Measured Harmonic Distortion at 100 dB SPL (1-m) with 50 Hz Sine-wave Signal

Predicted Effect of Feedback Duct Aspect Ratio on Frequency Response

COMPACT WIDEBAND BASS AND MIDRANGE HORN-LOADED SPEAKER SYSTEM

FIELD OF THE INVENTION

This invention relates to a device and method for generating and propagating sound waves, and more particularly, a compact, high efficiency, wide bandwidth and extended low frequency speaker system.

BACKGROUND OF THE INVENTION

In accordance with the present invention a compact high fidelity sound reproduction system is provided which is characterized by high efficiency, low distortion, wide bandwidth, and extended low frequency reach. The sound reproduction system or speaker can be used as a sub-bass woofer, bass woofer, mid-bass woofer, and mid-range speaker. Moreover, it can be used to achieve these range categories alone or in combination. Certain embodiments can even be effectively used over an octave range that spans at least, and even more than seven octaves, i.e., from 20 Hz to 1.5 kHz, with a single or multiple dynamic driver(s) and excellent acoustic efficiency (e.g., the present embodiment achieves 98 dB(C) (decibels, C-weighted) at 1 meter and 2.83 volts) and high fidelity performance (e.g., the present embodiment achieves a total harmonic distortion (THD) of <0.4% at 50 Hz, and 100 dB(C) sound pressure level (SPL) at 1 meter). The speaker of the present invention is particularly advantageous for use in public announcement type settings which cover large or open areas, although private acoustic enthusiasts could find use for the invention in part because of its relative small size (it is easily transported as it can be made having a small footprint, for example having a volume of less than two cubic feet and a weight of less than 30, or even 20 pounds), its efficient energy consumption, and suitability for use in public or private locations, including both commercial and residential applications. The new speaker technology presented here is a completely new alignment unlike any previous speaker topology (as evidenced by the unique electrical impedance plot containing at least 5 peaks).

In the past, sound reproduction systems have provided speakers using various means to achieve sound reinforcement systems or for stage performance systems for projection over large distances or in large spaces such as arenas and stadiums, but these have fallen short in one or more of the desired range of reproduction, the acoustic efficiency, the high fidelity performance, or the size of the device. The present invention addresses these and other objectives. It can be used for various media events that require sound reproduction or amplification, including for example, public speaking addresses; orchestral, dance and theatrical performances; rock, jazz or pop concerts; movie, surround sound or amusement park type experiences; places of worship; arena events such as sporting or skating; school presentations; and high fidelity home audio and home theater experiences; to name a few.

Some of the means which attempted to achieve these objectives presented by the prior art include (1) bass horns where the front of the driver cone is coupled to a front facing horn in the direction of sound propagation, and the rear of the driver cone is coupled to a sealed back cavity used to control the motion of the cone in order to maximize the SPL by limiting cone motion; (2) tapped horns where the front and rear side of a driver diaphragm are in communication through a common horn passage which is used to enhance the efficiency while keeping the horn size compact; (3) bass reflex speakers where a rear chamber is connected to the outside through a tuned duct in order to lower the system's resonant frequency; (4) transmission line speakers whereby the front or rear of a driver is in communication with a long duct that is open on the distal end so that it provides gain for the back wave from a driver cone; (5) mass-loaded transmission line, whereby a constricted duct is connected to the outside and serves to lower the resonant frequency of the TL; (6) back loaded horns where the backside of the driver cone is in communication with an expanding horn that serves to provide gain for the lower bass frequencies; (7) bandpass enclosures where the driver is enclosed within several chambers connected by ducts that serve to provide gain for lower bass frequencies through the tuning of multiple resonant chambers, one of which encloses the front face of the driver and another chamber which encloses the rear of the driver; or (8) so-called Karlson type bandpass enclosures where a curved aperture placed over the acoustic outlet serves to provide a dimensionally non-discrete mouth element so that resonant horn-induced peaks are reduced; and (9) a sealed chamber enclosure where the back cone volume is enclosed by a sealed box filled with acoustically absorbent material such as fiberglass, foam, or other fibrous material to absorb the back wave acoustic radiation.

The prior art systems all have a significant limitation in bandwidth of operation and are typically no wider than about 2 octaves (e.g., 20 Hz to 80 Hz, or 40 Hz to 160 Hz). Bass horns must be physically large in order to achieve bass extensions that reach 40 Hz due to the speed of sound and the required ¼-wave length of the fundamental frequency of the lowest note desired. In the case of 20 Hz, the nominal length of a bass horn is over 4.2 meters. This length coupled with a typical desired expansion ration of 1:10 will cause the resulting enclosure (even with folded passage ways) to be quite large for a bass woofer driver in the nominal 12-inch driver size. Another significant disadvantage of the prior art is that the large cone motions often cause higher harmonic distortion (as much as 10% to 30% THD). Such distortions make the bass notes sound 'muddy' or indistinct. Other disadvantages of prior art such as a bass reflex enclosure are significant delays in the arrival time of the sound as a function of frequency. This shows up as curves and peaks in an impulse response plot that is indicative of the timing (or phase distortion) that is produced by the speaker.

SUMMARY OF THE INVENTION

The present invention achieves a compact horn type loudspeaker that can produce bass notes, preferably in the 20 Hz to 450 Hz range, and more preferably in the 20 Hz to 1.5 kHz range, with High Fidelity (+/−5 dB frequency response across the systems useable bandwidth) and good efficiency (defined as >98 dB(C) at 2.83 volts and 1 meter) with low levels of harmonic distortion (<0.34% THD at 100 dB(C) SPL and 1 meter) and relatively flat/linear Group Delay (GD) with respect to GD being a function of frequency. Group delay is the temporal delay between sounds of different frequencies emitted by a speaker, and is typically large in the bass range. Low GD in a speaker system permits the timing of the perceived music with bass notes to be synchronous with the rest of the music frequencies in order to sound temporally 'clean'. By high fidelity, it is meant one or more of the following conditions apply: that the frequency response of the speaker should be fairly flat and linear over the frequency range of operation, that the harmonic distortion should be low, (i.e., less than 5%, and preferably less than 2%, and most preferably, less than 1% THD), and that the impulse response should show a rapid rise-time and rapid fall-time with a minimum of overshoot or oscillation over the frequency range of operation.

It is a further objective of the invention to produce bass and sub bass (optimally with a single speaker) while keeping the dimensions of the speaker enclosure or cabinet small relative to other horn loaded speaker topologies (typically resulting in >35% reduction in volume for a given low frequency corner target) for use in high fidelity audio system, home theater (HT) systems, or Professional Audio (PA) systems where flat and/or and linear frequency response and low harmonic distortion (HD) (i.e. harmonic distortion is evidenced when the speaker produces frequency components that are not part of the original audio input signal, and where the desired harmonic distortion is less than 5%, and even less than 2%, or more advantageously less than 1%).

It is also on object of the invention to achieve high efficiency in the system horn sound pressure levels of the range 95 dB(C) to 100 dB(C) (at 2.83 volts and 1 meter) so that the HD is minimized due to small diaphragm motions, and also to enable use in PA sound reinforcement systems or for stage performance systems where high SPL levels (>112 dB(C) at 1 meter) are required for projection over large distances or in large spaces, including for example concert halls; school, university or public auditoriums; open air amphitheaters or impromptu event venues such as parking lots or sports facilities; ball rooms; theaters; and conference presentation venues to name a few.

Although primarily aimed as a woofer or sub woofer for bass frequencies (20 Hz to 200 Hz), this invention can also be extended to higher frequencies that span the bass to upper mid-range (i.e., 150 Hz to 1 kHz, and more preferably 100 Hz to 3 kHz) simply by scaling the design appropriately smaller to match the higher frequencies of interest.

It is also an objective of the invention to allow simple mechanical tuning of the speaker's low frequency response by changing the feedback duct cross sectional area (CSA).

It is also an objective of the invention to dampen speaker cone motion below the low frequency cutoff preventing driver diaphragm or cone over-excursion can occur in Tapped Horns and other speaker alignments.

It is also an objective of the invention to be compact so that it may be placed inconspicuously and where further compactness can translate to reduced weight where bass producing speakers have previously been too heavy to loft, and allowing the innovation to be flown in arrayed concert sound configurations which was previously impractical. It is yet another objective for this innovation to provide high efficiency so that large spaces can be effectively filled with sound while keeping audio power amplifier requirements modest and speaker cone motions are minimized to keep HD low.

It is also an objective of the invention to provide ⅛th wave performance.

Particular applications of the invention include the following:

1.) pro audio (line arrays, clusters and front of stage installs)—auditoriums, churches, racetracks, public venues, stadiums, sound company rental gear; 2.) portable audio (compact sound reinforcement for rapid deployment outdoors or in small venues); 3.) media production studios editing/mixing/mastering/recording/post production); 4.) commercial theatre (iMax, Dolby DTS, etc.); 5.) home theater and hi-fi/audiophile users, where the applications might be grouped by the amount of more or less than 500 watts or electrical input power or having multiple drivers.

The invention can be described as front-loaded horn (i.e. a horn having a flared sound passage which is in communication with the front face of the driver) with a front chamber (i.e., an enclosure that resides in front of the front-facing diaphragm surface) that is in communication to the front horn (or that portion of the horn spaced from the throat and leading to the horn mouth) and in communication through a feedback duct (i.e. a channel that is smaller, for example less than 15% by volume, than a provided ring resonator). The feedback duct is in communication with an acoustic channel that forms a loop or ring-cavity, termed herein a "ring resonator", with the rear chamber (an enclosure that resides on the rearwardly facing side of the driver diaphragm) that is in communication with the ring resonator. This could also be considered traveling wave transmission line or "unbounded resonator". The ring resonator forms an open circuit, (i.e., having an inlet and outlet which may or may not be in equal communication), with the back chamber, so that it can be considered a path having an entrance and exit that are in equal communication with the back chamber (although this symmetry can be modified to achieve certain advantages). As used herein "in communication" means that the pressure waves freely transmit energy from one chamber to the next. Typically as used in the audio art, a horn is a duct connected at a narrow end, the throat, to a speaker driver (an electrical acoustic transducer which converts electrical energy into acoustic waves) and which flares to an outlet at the other, the mouth, similar to the flare at the bell end of a brass instrument, and which acts to improve the coupling efficiency between a speaker driver and air by providing impedance matching between the vibrations of a sound diaphragm and its corresponding higher velocity but low pressure variations with the relatively lower velocity but higher pressure variation sound waves in the duct and on exit into the surrounding environment. The purpose of the ring resonator is two-fold: (1) it provides an acoustically long (infinite length in principle) resonator or sound propagation loop or path with the ability to sustain many harmonics by permitting waves to form in a traveling wave resonator rather than a standing wave resonator thus extending the bandwidth of the front horn resonator; (2) it provides these numerous traveling waves to be used in reinforcing and amplifying certain frequencies in the front horn to effect a smoother frequency spectrum of sound waves that are sustained in the front horn which follows %-wave behavior for the most part. The feedback duct connecting or allowing communication between the ring resonator and the front horn serves to control, regulate or monitor the rate and/or phase of the energy transfer between the front horn resonator and the ring resonator/rear chamber. Additionally, the feed-back duct is an integrated conduit which provides a path of integration between the looped acoustical duct and the horn mouth, and it serves as a means to enable energy transmission from the looped acoustical duct to the front horn that can be used to control the rate of energy transfer between the ring resonator and the front horn where there may be an asymmetrical bias from the initial speaker driver push. Thus, simply, the invention can be said to comprise a wave generation or propagation device that provides a horn connected at the rear end to a ring resonator (which may further be a folded ring resonator), which is also in dynamic communication with the front of the horn by means of a feed-back duct. In a further aspect of the invention, the feed-back duct is adjustable, such as in width and length or volume. Changes could be made to the surface characteristics, the material characteristic or damping material could be added in the feedback duct to change the sound characteristics including to tailor the sound characteristics to achieve a specific effect. Changes in the geometry of the feedback duct changes the bass extension where wider or shorter allows a lower bass extension, but at the expense of reduced sound pressure level. Also a narrow channel or long channel has a more gentle rate of sound fall-off in the low frequencies. Conversely, for example in a driving techno-hip-hop type sound, many prefer the rapid falloff but deeper bass extension, and in this case, the feedback duct has a larger aspect ratio. The aspect ratio of the feedback duct is the ratio of the width (thickness of the feedback duct channel) divided by the length and in the following ranges depending on the frequency application 0.01 to 0.1, and in categories of 0.01 to 0.03; 0.03 to 0.05; and 0.05 to 0.1, corresponding to studio mastering/mixing monitoring; high fidelity/home theater; and pro audio/public address applications, respectively. The feedback duct allows for phase sensitive feedback where the feedback of the pressure wave in the front horn is affected by means of the length of the feedback duct which allows the phase of the front and back of the speakers drivers to combine at an optimal phase, i.e. smaller than 90°. Finally, the system provides an interface between the ring resonator and the front horn that happens in such a way to allow the phase recombination to be optimized.

The invention also has a surprising application as a wide-bandwidth bass sound trap absorption system.

BRIEF DESCRIPTION OF THE DRAWINGS

FIG. 8(*b*) is schematic topology diagram of a third embodiment of the invention comprising a circular bass horn with a ring resonator and feedback duct;

FIG. 8(*c*) is schematic topology diagram of a fourth embodiment of the invention comprising a switchable path bass horn with a ring resonator and feedback duct;

FIG. 8(*d*) is schematic topology diagram of a fifth embodiment of the invention comprising a transverse bass horn with a ring resonator and feedback duct;

FIG. 8(*e*) is schematic topology diagram of a sixth embodiment of the invention comprising a co-axial horn with a ring resonator and feedback ducts;

FIG. 8(*f*) is schematic topology diagram of a seventh embodiment of the invention comprising a horn with a ring resonator that utilizes a Moebius half-twist and a feedback duct;

FIG. 11(*b*) is a plot of the predicted impedance of an infrasonic subwoofer example of the present invention;

FIG. 12(*b*) is a plot of the predicted impedance of an wide-bandwidth subwoofer example of the present invention;

DETAILED DESCRIPTION OF THE INVENTION

Figure 1:
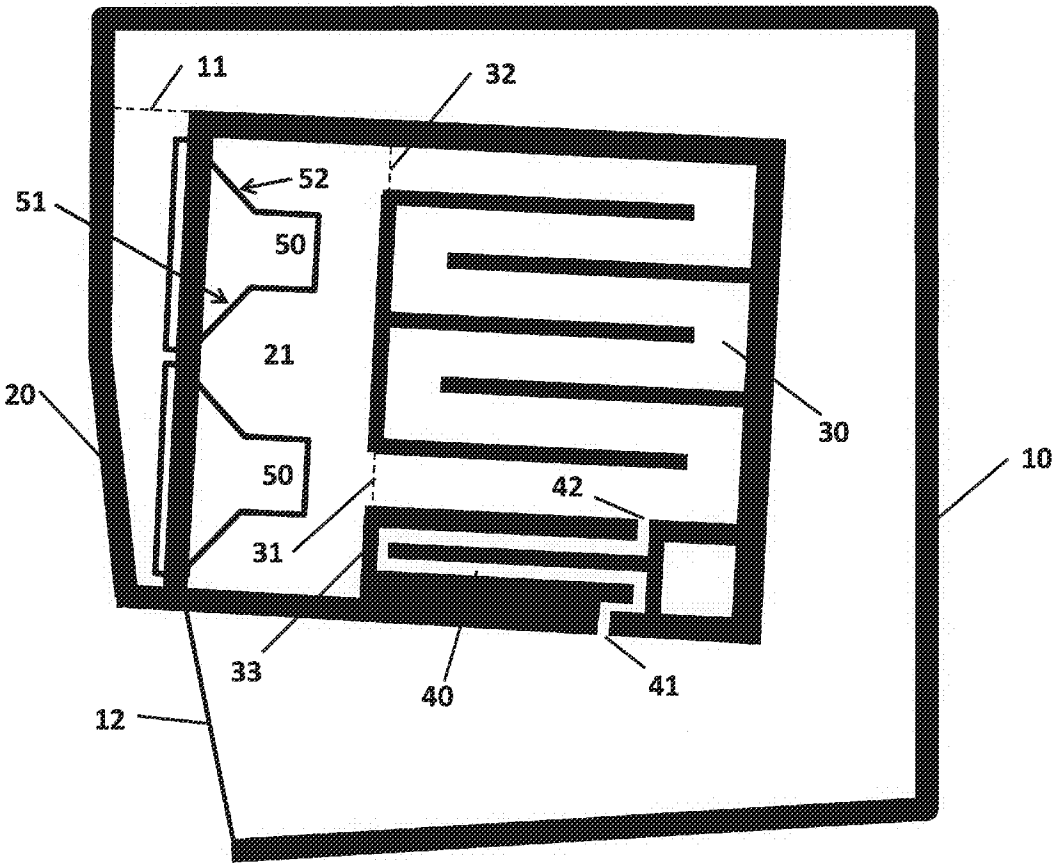
FIG. 1 is a cross-sectional schematic side view of a first embodiment of the invention.

FIG. 1 illustrates the present technology which includes a folded bass horn, with drivers 50 which provide pressure stimulus to the system and separate the front (meaning located in advance of the speaker driver or the sound waves directed outward of the wide mouth of the drivers) compression chamber 20, and back (meaning in arrears of the sound waves directed outward of the wide mouth of the drivers) chamber 21, but modified with the addition of a ring resonator duct 30, which connects or is in wave communication with the back chamber 21 with itself through two openings or passages 31 and 32, and a long feedback duct 30 of approximately the same length (i.e. plus or minus 10%, preferably 5%) as the front horn 10, but with a much smaller constant cross section, and the addition of a feedback duct 40 between the ring resonator 30 at an opening 42 located near one end of the ring resonator 30, and the front horn 41 near the mouth 12. As used herein, communication between the various chambers, ducts or void spaces means acoustical communication in which the spaces may be open between each area to form contiguous spaces, or can mean having some other form of muted or attenuated communication in which a diaphragm or sound transmitting barrier is located. In this example, the ring resonator 30 and feed-back duct are both folded to increase the length while decreasing the volume of space needed so that the speaker can be more compact. As is illustrated in the figures, folded as used herein means that the structure which defines the chamber, space or void that forms the ring resonator duct may have a path way that doubles back on itself in an angle of from 45°, or more preferably from 90° to 180°, such as a serpentine or maze-like configuration.

Figure 2:
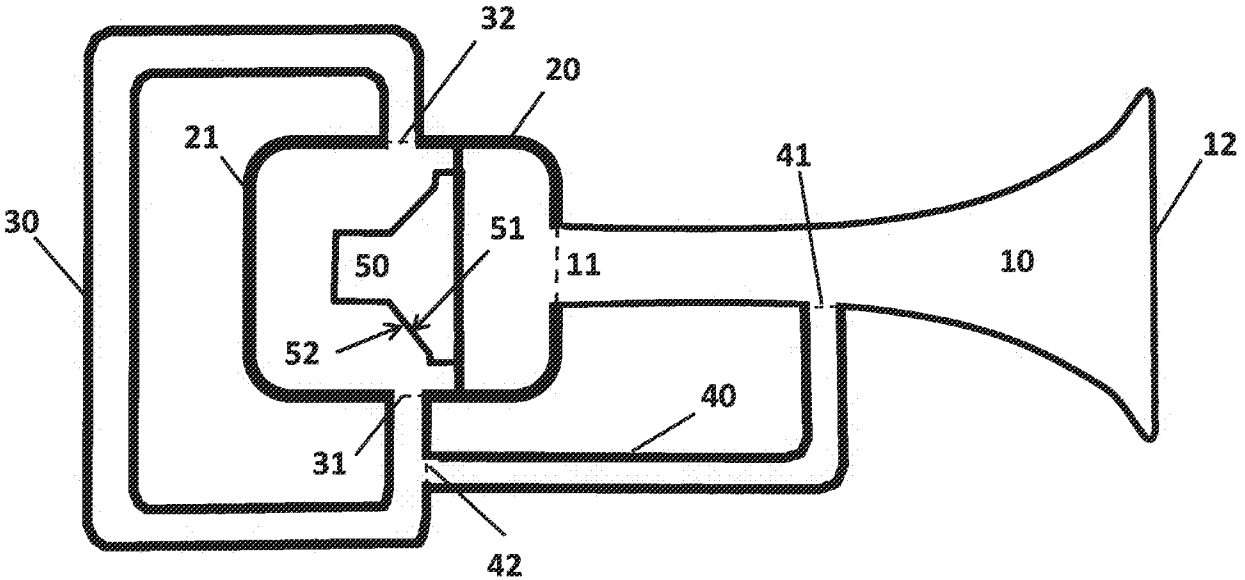
FIG. 2 is a simplified schematic diagram of the first embodiment of the invention.

FIG. 2 shows the preferred embodiment as the key components described in a simplified schematic showing the system topology again in medial sagittal cross-section. Driver 50 serves to initiate pressure stimulus to the sound diaphragm 51 which is a flexible material that acts to generate sound waves in response to the initiation of the driver and also separates the front horn compression chamber 20 from the rear chamber 21, which is connected to a ring resonator duct 30. The ring resonator duct 30 is connected to the front horn 10 through a feedback duct 40 at openings 41 and 42 located on the front horn near the mouth, and on the ring resonator duct 30 near one of the openings 31, respectively. The speaker is contained within a housing which optionally enhances the sound characteristics or the design aesthetics.

For the purposes of this patent, a "horn" will be considered to encompass a geometry that expands. The geometry of a horn is an expansion that provides impedance matching between the speaker diaphragm (limited surface area) and air over a bandwidth of acoustic frequencies. The invention can be implemented as shown in FIG. 1 using rectilinear segments, which help ease of fabrication using traditional carpentry/woodworking techniques.

As shown in FIG. 2, in operation, the electrical signals from an amplifier (not shown) excite a voice coil which generates pressure waves from the driver diaphragm 51 to produce sound waves in the front compression chamber 20 which then travel through a throat 11 and out towards the front horn 10 and radiates into free space at the horn mouth 12. Simultaneously, the rear face of the driver diaphragm 52 generates pressure waves in the rear chamber 21 (which is typically a void that is formed to the rear of the driver diaphragm) which subsequently travel into the ring resonator duct 30 through both openings 31 and 32. Since the rear chamber 21 and the ring resonator 30 form a continuous loop duct, sound waves can travel in both directions and in certain conditions travel preferentially in one direction due to asymmetry caused by the location of the feedback duct opening 42 being located towards one entrance 31 of the ring resonator 30. This asymmetry can also be achieved by making the rear chamber and the location of the ring resonator entrance different with respect to whether or not the sound travels through one entrance or the other as is shown in FIG. 1 by having a step boundary 33 to offset the distance of the entrance 31 relative to rear chamber 21 wall. Note that in FIG. 1, the entrance 32 is flush with the rear chamber 21 wall. In the description of the operation of this invention that follows, we posit the principle and modes of operation that are responsible for the remarkable performance of this invention. In the event that the principle and modes of operation described herein is shown at a later time to be incorrect, the uniqueness and novelty of the speaker alignment and topology, is still valid. The traveling waves in the acoustic loop circuit formed by duct 30 and rear chamber 21 have their acoustic power fed by the pressure waves supplied by the rear diaphragm surface 52, this traveling wave acoustic power is then bled off through a feedback duct 40 which provides some resistive pressure losses in order to control the rate of energy depletion from the main ring resonator 30. It is critical that the pressure flow through the feedback duct 40 have resistance and finite length because it provides a controlled coupling of the power and phase of the energy transfer between the front horn 10 and the ring resonator and back chamber in such a way that the effective bandwidth is increased both in the lower octaves and higher octaves while smoothing out the peaks and fluctuations that are normally present in prior-art designs due to the impedance mismatch constructive interference caused by the reflection of the sound wave from the front horn mouth 12 back to the sound wave in the back chamber 21. The width or cross sectional area of the feedback duct 40 controls the rate of the energy coupling between the ring resonator 30 and the front horn 10, whereas the length of the feedback duct 30 controls the phase relationship between the two. The proper control of the coupling power and phase allow the initially 180 degrees out-of-phase acoustic energy in the rear chamber 21, to be efficiently and accurately applied to amplify the power and extend the bandwidth of the front horn 10 at both the lower extent of the innovation's frequency bandwidth and the upper range of the bandwidth while smoothing out the normal ripples and peaks associated with the prior art designs.

Figure 8:
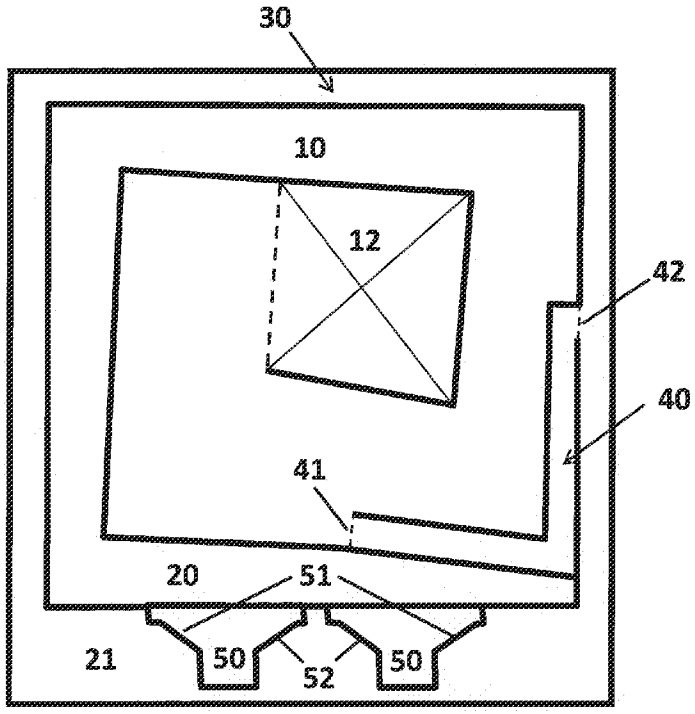
FIG. 8(*a*) is schematic topology diagram of a second embodiment of the invention comprising a central-mouth bass horn with a ring resonator and feedback duct.
Figure 8:
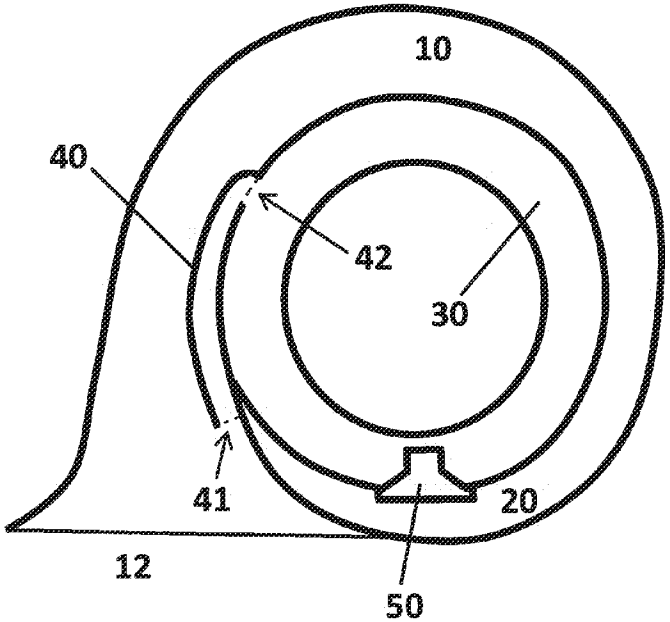
Figure 8:
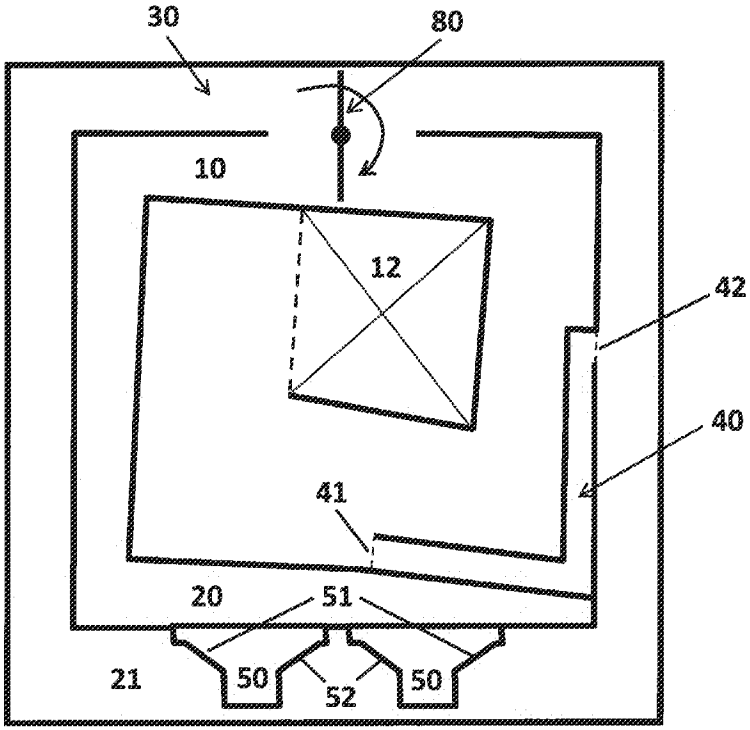
Figure 8:
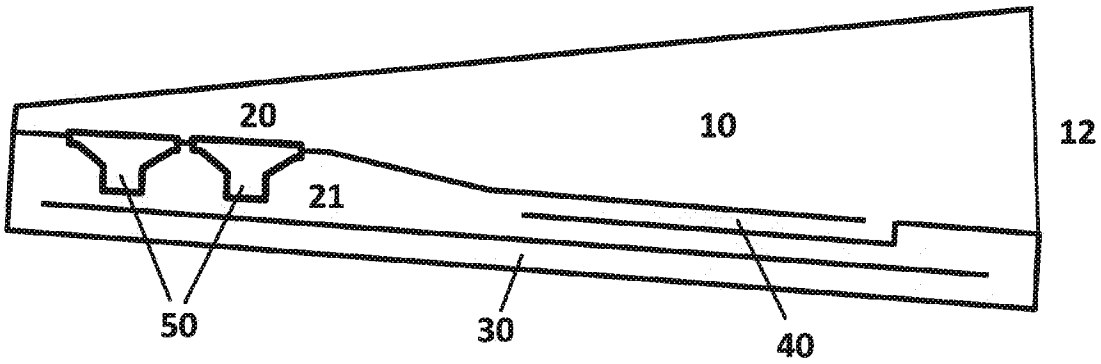
Figure 8:
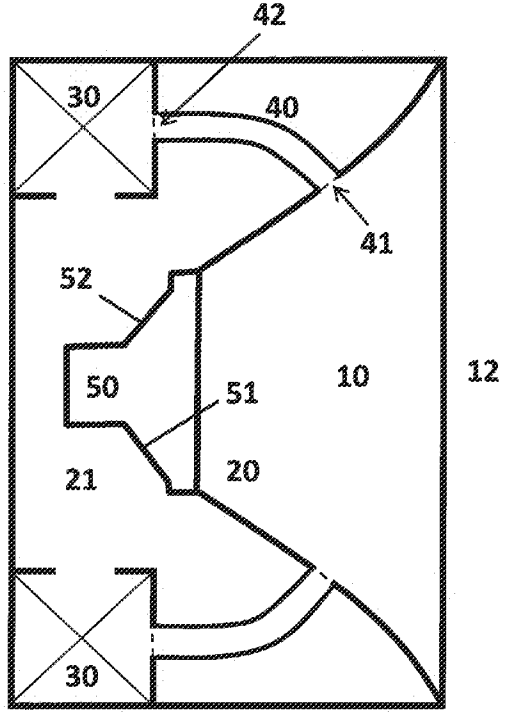
Figure 8:
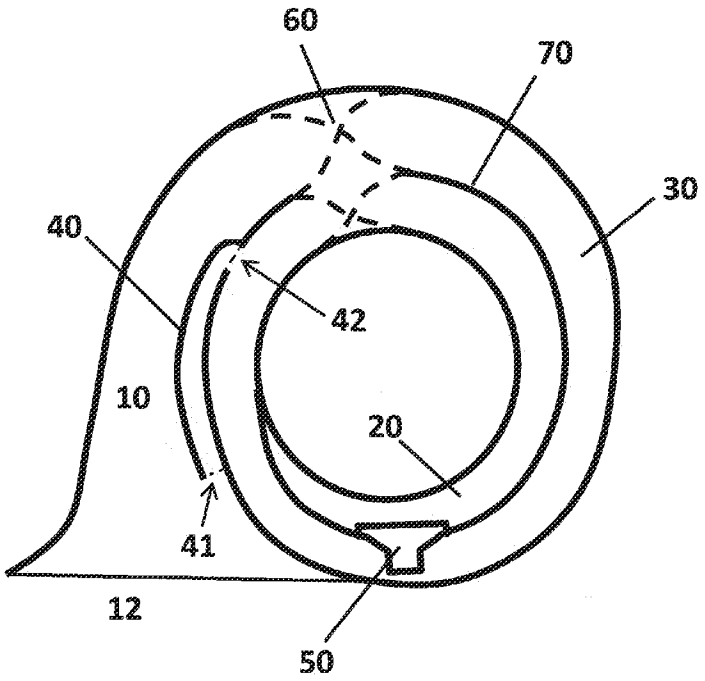

While, the preferred embodiment of this innovation is shown in FIG. 1, alternate embodiments that provide the same flow topology may also be used to affect the same function. Although several designs of alternate embodiments are shown here, they are not exhaustive and designs not shown here may still be within the scope and intent of the present invention with some simple modifications that are easily accomplished by one possessing ordinary skill in the art of horn speaker design. FIGS. 8(*a*) to (*e*) shows several alternate embodiment where the main design of a driver 50 separating a front 20 and rear 21 chamber with the front chamber connected to a front main horn 10 leading to a horn mouth 12, where a feedback duct 40 connects the ring resonator 30 between two openings located in the feedback duct at the front horn 41 and ring resonator 42. FIG. 8 (*b*) shows an embodiment where the driver 50 is in communication with the front chamber 20 of the main horn 10, that circumscribes the exterior perimeter of the ring resonator 30, which occupies the interior side of the ring-like horn with a feedback duct 40, that is connected between the region near the horn mouth 12 by feedback duct entrances 41 and 42. FIG. 8(*c*) shows a design with a novel butterfly valve 80 that when flipped, switches the operation of the present invention from ring resonator with feedback to a bass horn with feedback (or a tapped horn with damped feedback). FIG. 8(*d*) shows an alternate embodiment whereby the flow passages are predominantly aligned in one parallel direction for a long but narrow speaker cabinet, which may be useful for applications where a predominantly tall aspect ratio enclosure is preferred. FIG. 8(*e*) shows an alternate embodiment where the horn 10 is predominantly axially aligned with the driver diaphragm 51 and 52, much like a short waveguide, and with the ring resonator 30 which is tangentially flowing out of the page as drawn and has multiple feedback ducts 40 connecting several locations of the ring resonator 30 to the front horn 10. FIG. 8(*f*) shows a circular embodiment, similar to the notation used in FIG. 8(*b*) but wherein the flow passages of the main horn 10 and ring resonator 30 achieve a half-twist (180 degrees along the axis of flow path) 60 in the flow passages like a Moebius strip thereby enabling the ring resonator 30 to be located on the inside and outside faces of a separator wall 70.

In accordance with an additional aspect of the invention, the speaker drivers can be substituted with absorptive acoustic dampeners to create a compact wideband acoustic trap (commonly referred to as a bass trap). Helmholtz resonators and bass traps are typically large wherein the present invention can be very compact and implemented as a bass trap simply by placing a resistor across the terminals of the speaker driver or placing heavy rubber inserts in place of the speakers to accomplish a wideband acoustic damping enclosure.

Figure 3A:
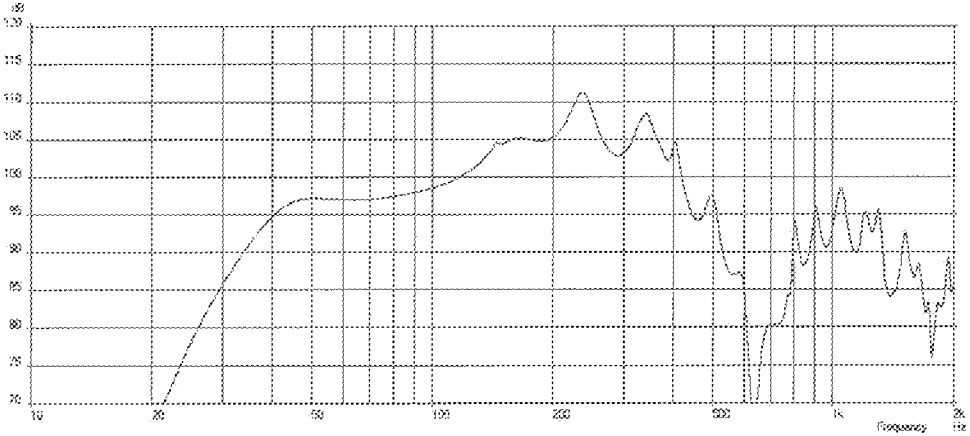
FIGS. 3(*a*) and 3(*b*) is the predicted frequency response and impedance for the present invention.
Figure 3B:
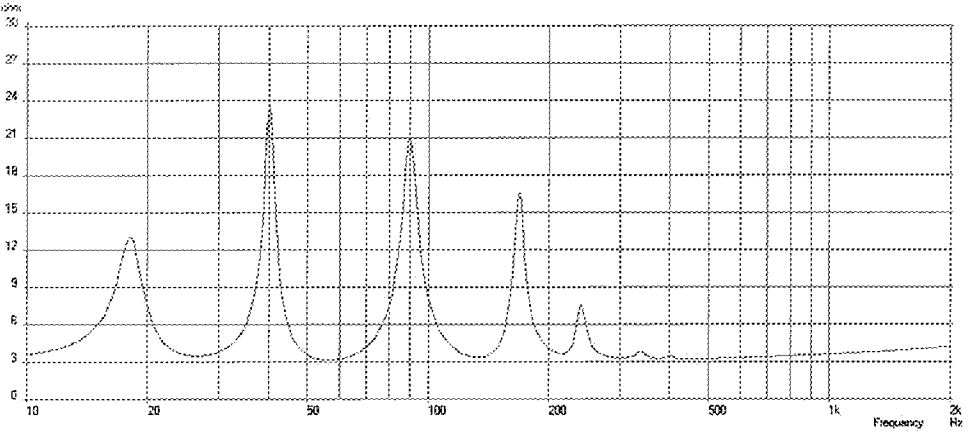

Supportive Theory:

In order to develop and optimize the dimensions and placements of the ring resonator, feedback duct, rear chamber volume, and front horn dimensions, the use of a comprehensive computer model of the physics of this innovation was used. This model was implemented using a lumped-element 1-dimensional acoustic model formalism through a commercially available software package. By use of the software simulation, the innovation was designed completely on computer and a computer aided drafting (CAD)

drawing of the final system was developed which was used to build the prototype. FIG. 3*a* shows a graphical representation of the frequency response in sound pressure level in dB vs frequency (Hz) of the present invention in its preferred embodiment using quadruple 5-inch class woofer drivers with a front main horn of 1.8 meter length. FIG. 3*b* shows the corresponding predicted electrical impedance of the speaker system. Note that in FIG. 3*b*, as well as in subsequent figures depicting the electrical impedance of the present invention that there are at least 5 impedance peaks visible and this is indicative as a signature of the present technology when contrasted to prior-art speaker alignments such as bass horns, tapped horns, and bass reflex, which all typically have fewer than 5 impedance peaks.

Figure 4:
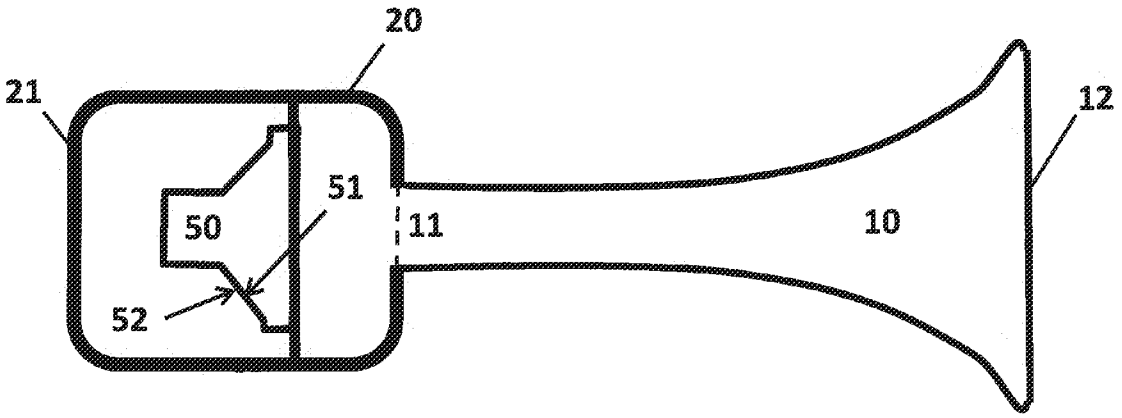
FIG. 4 is a schematic topology diagram for the prior art bass horn speaker.
Figure 5A:
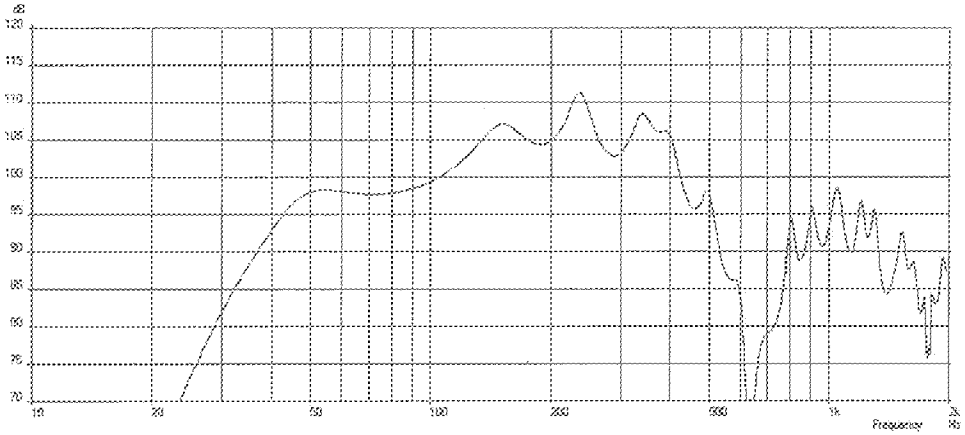
FIGS. 5(*a*) and 5(*b*) is the predicted frequency response and impedance for a prior art bass horn speaker.
Figure 5B:
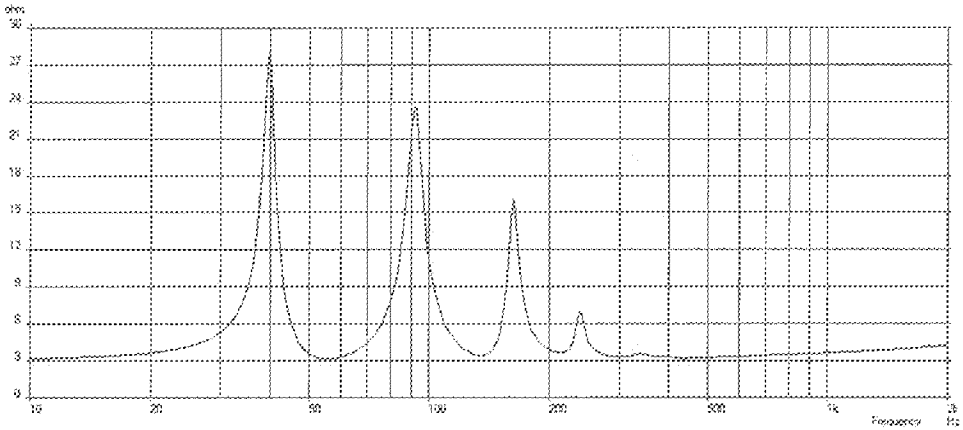
Figure 6:
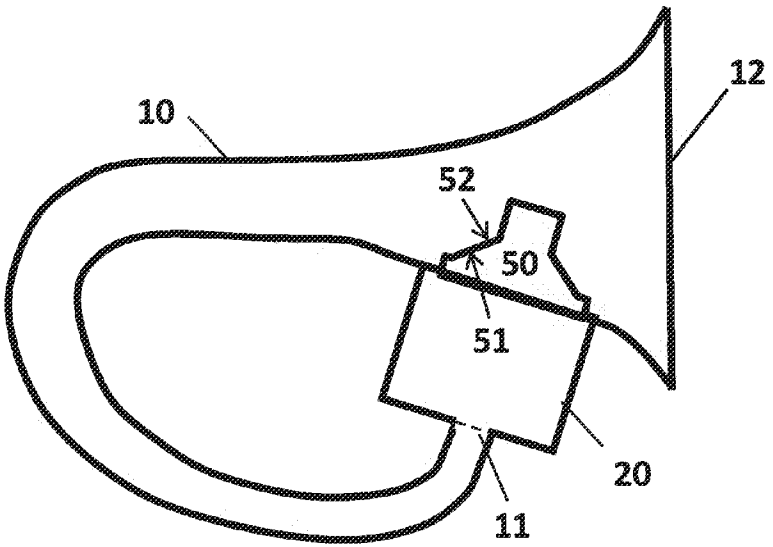
FIG. 6 is a schematic topology diagram for the prior art tapped horn speaker.

In the subsequent speaker alignments presented, the model of the present invention which produced the data shown in FIGS. 3*a* and 3*b* is simply altered to close off or relocate the ports and ducts in order to convert the flow passage topology shown in FIG. 2 to represent the topologies shown in FIGS. 4 and 6, while keeping the driver chamber volumes, horn length and mouth area constant. For the purposes of illustrating the differences in the speaker alignments between the present invention and prior art, the following simulations will be used. FIG. 4 shows the typical arrangement of a bass horn with a driver 50 and driver diaphragm front face 51 and driver diaphragm rear face 52 separating the front 20 and rear 21 driver chambers. The front driver chamber 20 is connected to the front horn 10 through a throat (i.e., a constriction) 11, and the rear chamber 21 is acoustically isolated from the front horn 10 (by the diaphragm). The design of a typical bass horn shown in FIG. 4 is typically optimized to provide proper acoustic impedance loading of the driver diaphragm motion so that for small movements, large sound pressure levels are created at the mouth 12 of the horn. By optimizing the flow passage topology including the chamber volumes, chamber throat length and cross-sectional area, horn and mouth length rate change of volume (or horn expansion rate) for a given set of driver performance parameters (the so-called Thiele-Small parameters), a sound pressure level versus frequency plot as shown in FIG. 5 can be achieved. In FIG. 5, the typical bass frequency extension of the bass horn is dictated predominantly by the length of the horn as this sets the ¼-wave fundamental resonance frequency. The typical behavior of a bass horn as shown in FIG. 5 achieves remarkable efficiency but often suffers from horn resonance and modulation peaks which occur at the high frequencies where the reflection of the forward propagating wave combines back at the driver to cause a series of peaks followed by a large dip. The bandwidth of a bass horn can be large, up to 4 to 6 octaves (40 to 500 Hz) but is plagued by rather large oscillations due to the resonances characteristic of a bass horn. The present invention achieves real horn loading, across several octaves, starting in low bass range, without ripple.

Figure 7A:
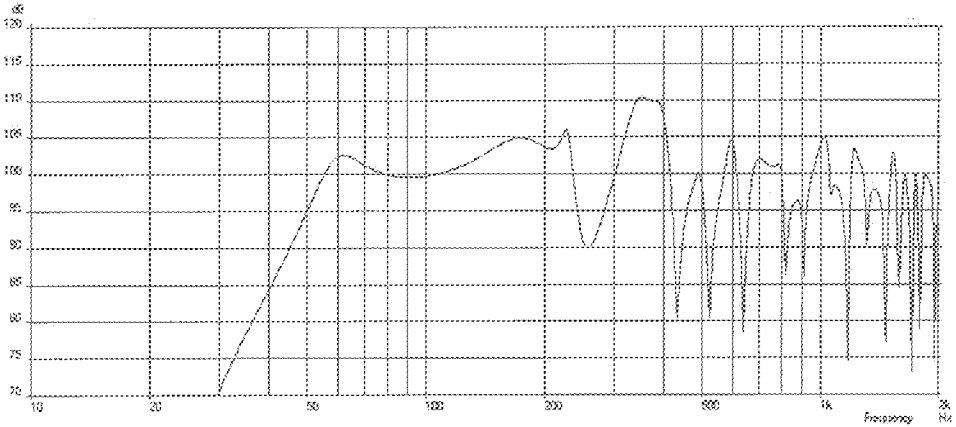
FIGS. 7(*a*) and 7(*b*) is the predicted frequency response and impedance for a prior art tapped horn speaker.
Figure 7B:
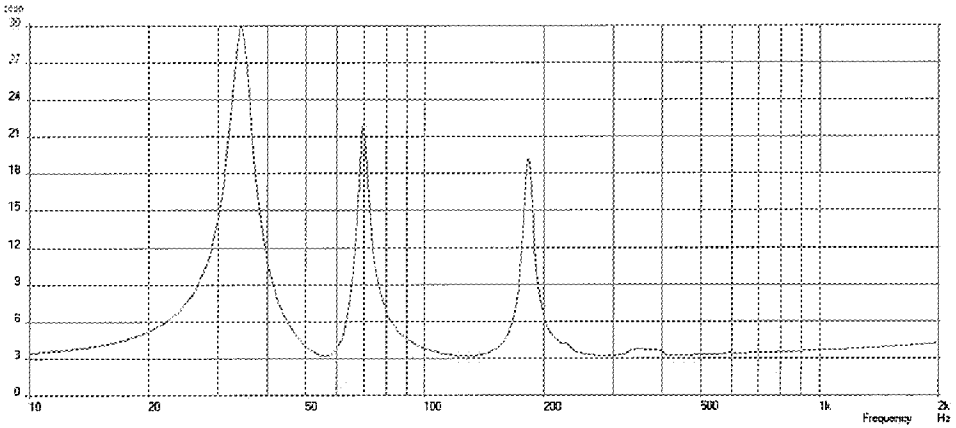

FIG. 6 shows a typical so-called tapped horn design of the prior art. Here, the driver 50, has front 51 and back 52 diaphragm faces which also separate front 20 and back chambers, but in this case the back chamber is essentially the front horn 10 mouth 12 region. In this design, the direct coupling of the front horn 10 acoustic pressure near the mouth with the diaphragm 51, 52 generates, the tapped horn automatically provides variable Thiele-Small parameters for the driver (through the apparent driver suspension stiffness that is modulated by the differential pressure) that allows optimal phase matching and acoustic impedance matching of the front and rear acoustic waves so that a higher efficiency and deeper bass extension may be achieved for a horn length that is smaller than the bass horn. FIG. 7 shows the typical frequency response of the tapped horn as shown in sound pressure level versus frequency response plot. In FIG. 7, we can see that the typical tapped horn behavior achieves lower bass extension than the bass horn for the same horn length, higher acoustic efficiency, but suffers from reduced frequency bandwidth due to the requirement that the tapped horn acoustic gain bandwidth only occurs over a frequency range where the front and rear waves interfere constructively within the driver's suspension and electromagnetic characteristics as set by the Thiele-Small parameters. This is also known as the 'band pass' alignment effect where anytime a driver's cone is subjected to the pressure feedback from the cone's motion through a speaker system. Other examples of band pass effects are $4^{th}$ and $6^{th}$ order reflex woofer enclosures. The bandwidth of a tapped horn is typically 4+ octaves (40 Hz to 200 Hz for example) before a large peak followed by a sharp dip signifying the point at which the two front and back waves cancel each other.

Figure 9:
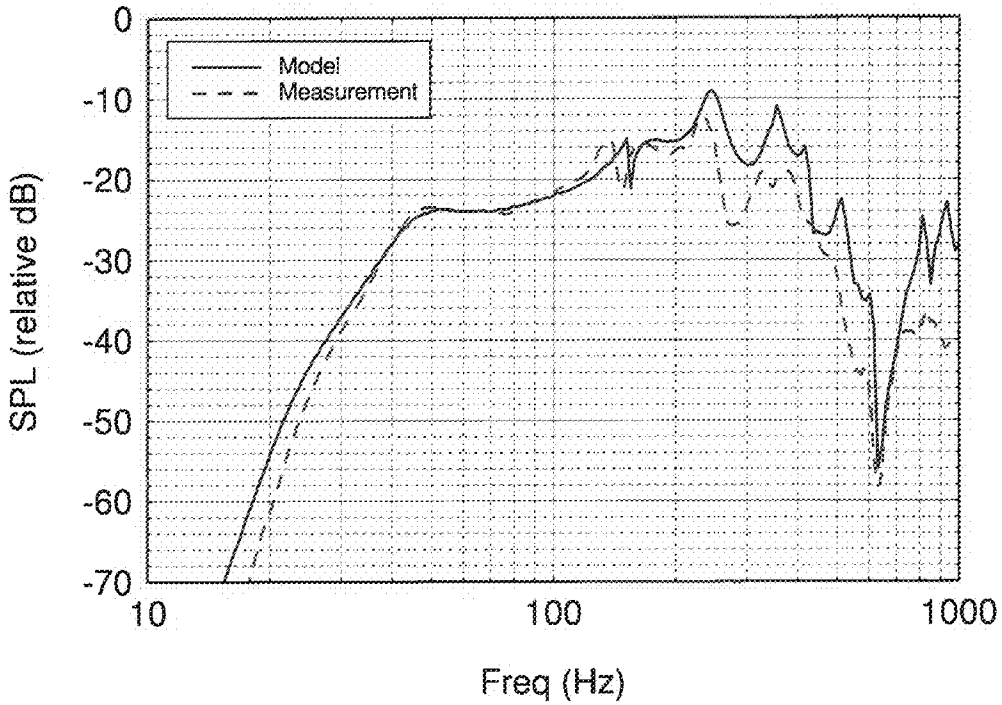
FIG. 9 is a comparison of the model of the SPL as a function of frequency and the actual measured values.
Figure 10:
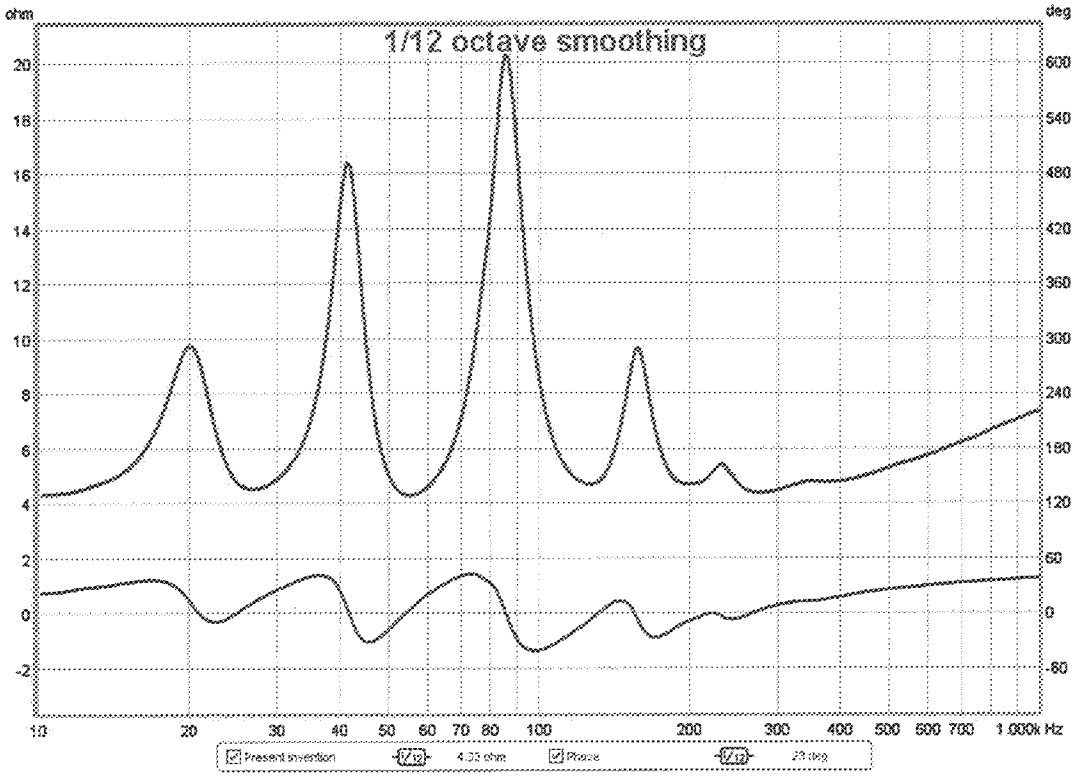
FIG. 10 is a plot of the measured electrical impedance and phase performance of the present invention.

FIG. 9 shows the comparison of the predicted frequency response with the measured frequency response for the embodiment shown schematically in FIG. 1 which uses quadruple 5-in class woofer drivers and a 1.8 m long nominal front horn path length with a 1.8 m long ring resonator, and a 0.43 m long feedback duct that is 12 mm in thickness and 0.36 m in width. The predicted and measured sound pressure level and the corresponding locations of the peaks and dips in the response compare very well, and is indicative of the fidelity of the model which gives credibility and confidence to the subsequent simulations showing the expanded capabilities of the present invention. FIG. 10 shows the measured electrical impedance and phase of the embodiment depicted in FIG. 1 and response shown in FIG. 9 which clearly shows the presence of 5 impedance peaks and their relative heights which compare well with the impedance peak locations predicted by the model in FIG. 3*b*. The measurement of the impedance peaks is sometimes used as a method of identifying the 'signature' of an acoustic alignment.

Figure 11A:
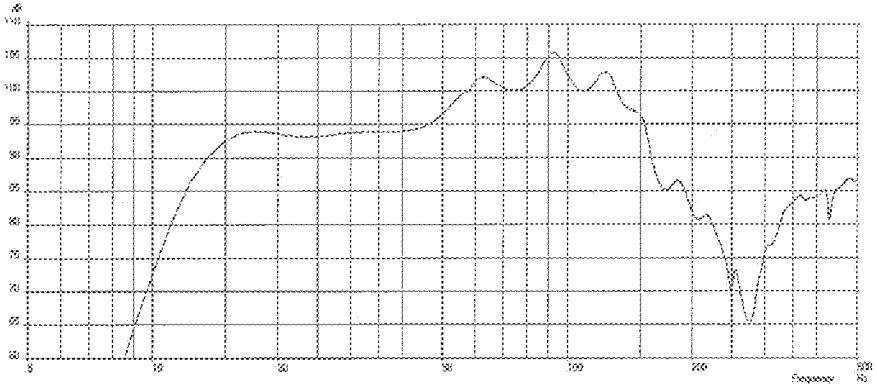
FIG. 11(*a*) is a plot of the predicted frequency response of an infrasonic subwoofer example of the present invention.
Figure 11B:
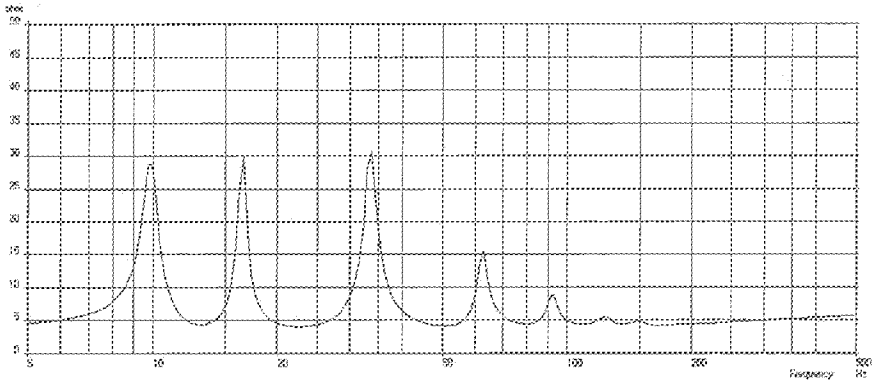

FIG. 11*a* shows the predicted frequency response of an example of an infrasonic subwoofer application using the topology of the present invention, where the bass extension at the −3 dB point is approximately 14 Hz (well below the audible range of human hearing, and in the so-called infrasonic range where pressure vibrations from the music can be felt by the body rather than heard, useful for home theater applications). What is remarkable is that a high efficiency (approx. 94 dB) and dip-free response can be maintained from 14 Hz up 150 Hz. The peaks from 60 Hz to 120 Hz can be smoothed readily with equalization available in most home theater receivers that utitlize digital signal processing (DSP) without introducing distortion since the peaks are reduced rather than dips/valleys being amplified. FIG. 11*b* shows the corresponding predicted electrical impedance of the above infrasonic subwoofer showing that the impedances are in the normal range of most common power amplifiers.

Figure 12A:
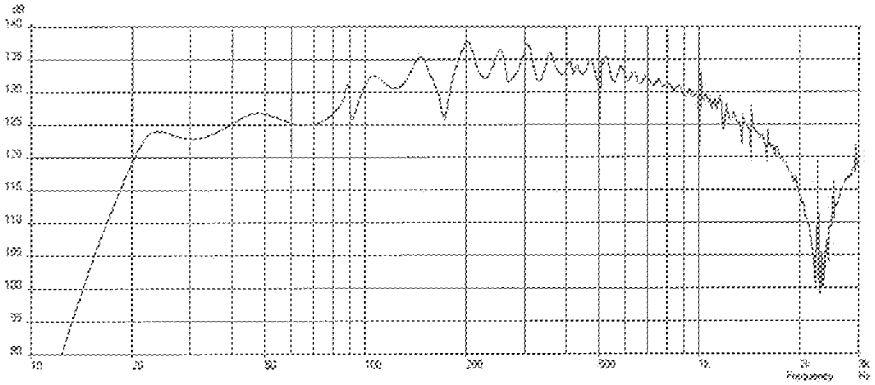
FIG. 12(*a*) is a plot of the predicted frequency response of a wide-bandwidth subwoofer example of the present invention.
Figure 12B:
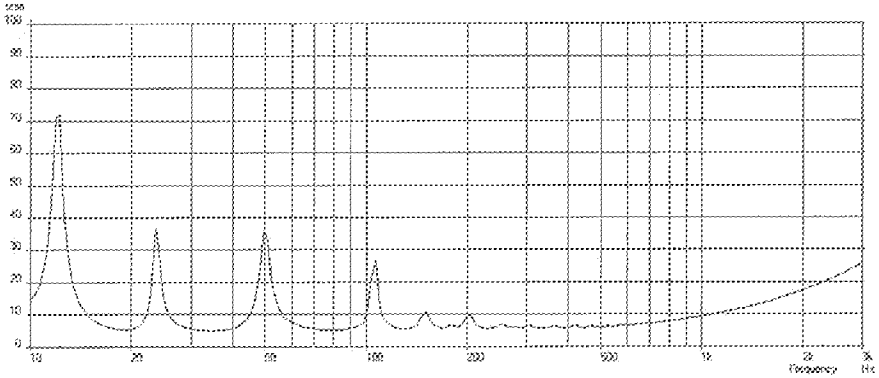

FIG. 12*a* shows a graphical representation of the predicted frequency response of the present invention in an application as an ultra-wide bandwidth subwoofer using a 15 inch driver with a main front horn length of 3 meters. The data in FIG. 12*a* is calculated for the case of the speaker being driven at maximum (cone excursion limited) input power. Note the very wide bandwidth that was achieved ranging from 23 Hz to 1500 Hz, a 7+ octave span. Again, the peaks above 125 dB can be reduced through equalization in DSP readily without affecting distortion to produce a flat response that enables this speaker technology to serve as both a near infrasonic subwoofer to a midrange woofer such that only a tweeter operating above 1500 Hz would be needed to complete the full range of sounds.

Figure 13:
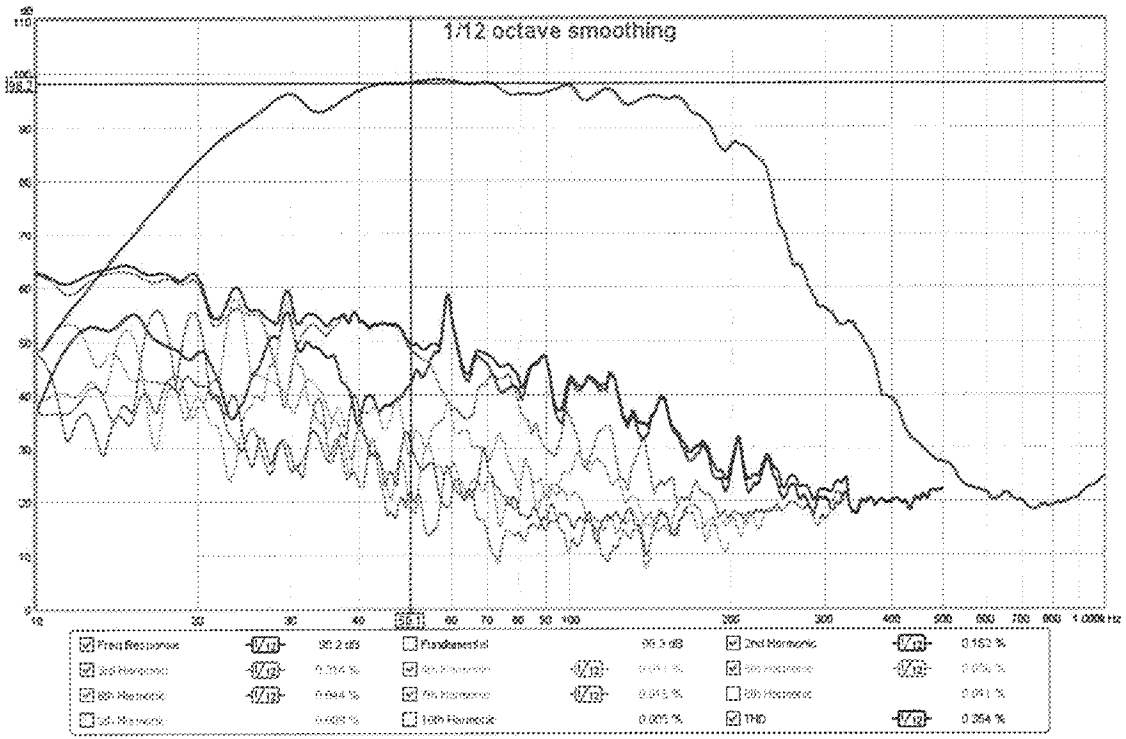
FIG. 13 is a plot of the measured frequency response and distortion at 1 meter.
Figure 14:
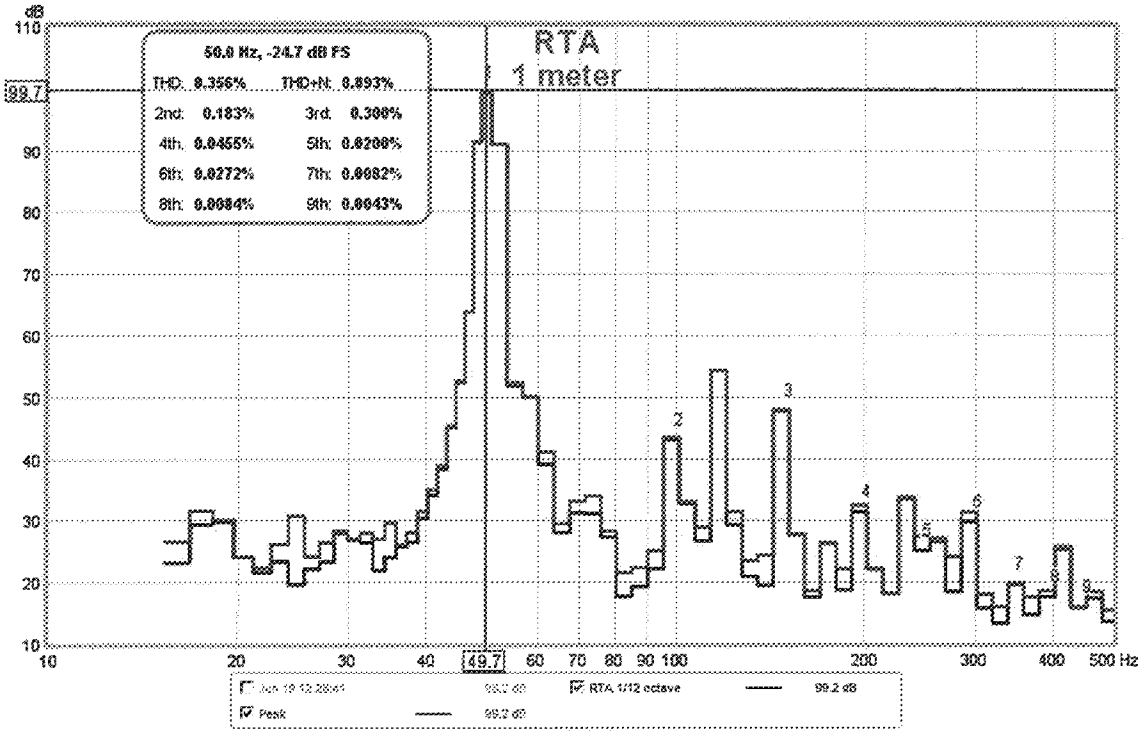
FIG. 14 is a plot of measured harmonic distortion and harmonics at an output level 100 dB(C) SPL (1-meter) with a 50 Hz sine-wave signal input.

FIG. 13 is a plot of the measured frequency response and distortion at 1 meter with the amplifier set to produce an approximate output SPL near 100 dB(C) in an indoor corner-loaded placement typical of how the present invention would be utilized in either a home theater or high fidelity application. Note that the measured harmonic distortion is about −55 dB at 200 Hz and rises to about −50 dB at 50 Hz—a remarkable performance figure for a subwoofer at close to 100 dB. FIG. 14 is a graphical representation of the plot of real time analysis (RTA) measured harmonic distortion at a reference SPL of 100 dB(C) SPL at 1 meter with 50 Hz sine-wave signal input, showing that the measured THD value at 50 Hz is indeed only 0.356%, with the largest HD components in the second and third harmonic being about −55 dB below the fundamental frequency. These data show the remarkable low HD capability of the present invention and how it enables true high fidelity low distortion output suitable for many applications.

Figure 15:
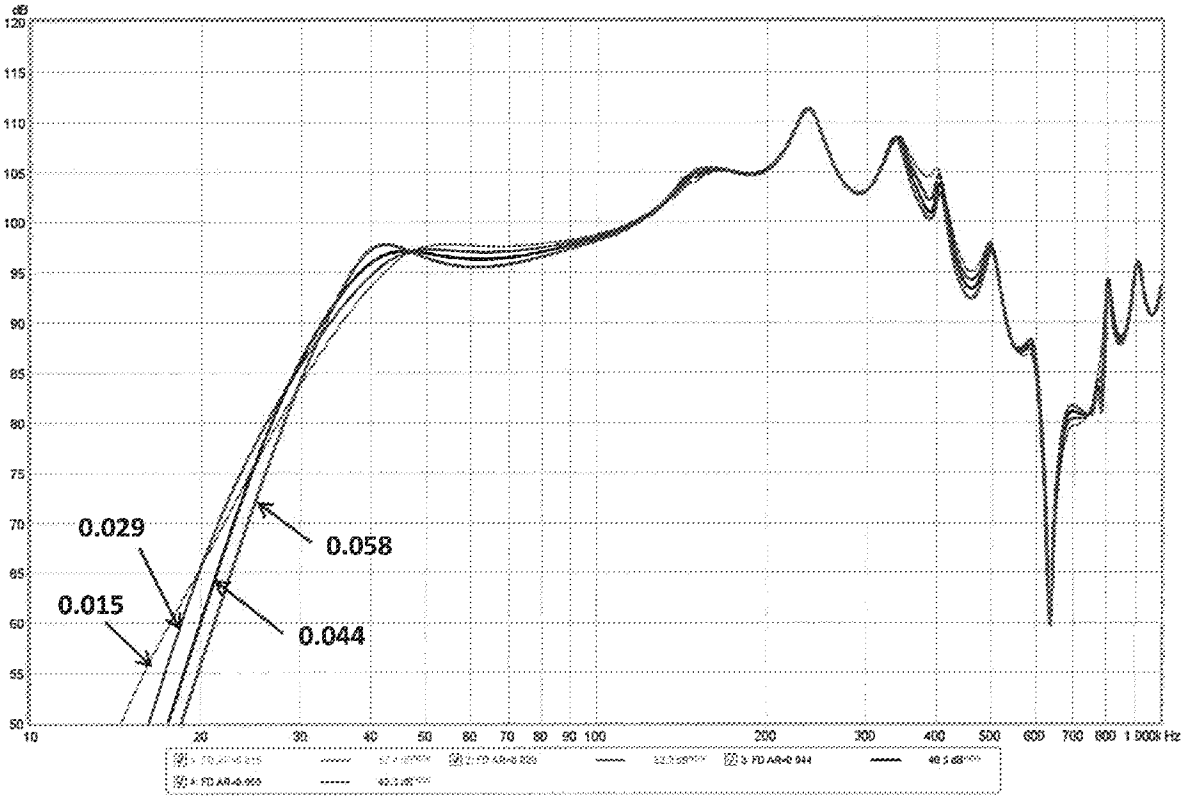
FIG. 15 is a plot of the predicted frequency response vs. the aspect ratio of the feedback duct for the present invention in its preferred embodiment as shown in FIG. 1. Here, the aspect ratios for the feedback duct are: 0.015, 0.029, 0.044, and 0.058.

FIG. 15 shows a graphical representation of the effect of the aspect ratio of the feedback duct on the predicted frequency response of the preferred embodiment of the speaker as shown in FIG. 1. The aspect ratio was varied in the model by changing the height of the feedback duct channel spacing from 6.37 mm to 25.4 mm for a feedback duct length of 437 mm long. This results in an aspect ratio that varies from 0.015 to 0.058, corresponding to the extremes of a studio mastering/mixing monitor application, to a pro audio application, respectively. From FIG. 15, we can see that the larger the aspect ratio is, the deeper the bass extension becomes but at the expense of flatness of the response, and in a more rapid bass falloff slope. In contrast to a bass reflex alignment where a larger aspect ratio (with the length being held constant), always results in less bass extension, whereas in the present invention, there is the opposite effect of more bass extension. It is possible to design and implement either a modular feedback duct with various preset heights and/or lengths to quickly tailor the speaker system to an intended application. Alternatively, a mechanism can also be designed and implemented to allow real-time adjustment of the feedback duct aspect ratio either through variable height or length. Such a mechanism could be implemented using an adjustment system comprised of mechanical screws/cams/ramps/gears to effect the desired aspect ratio. Such a system is useful for real-time on-the-field adjustment and tuning of the speaker system to suit the intended usage or to compensate for external acoustical room modes and other effects.

What is claimed is:

1. A sound reproduction system comprising a front horn, a speaker driver in communication with the front horn, a front acoustical chamber, a rear acoustical chamber, an acoustical duct having a first opening and a second opening and a feed-back duct, wherein the front chamber is in communication with a front horn, and the rear acoustical chamber is in communication with the first opening of the acoustical duct and with the second opening of the acoustical duct such that the acoustical duct forms a path having a first and a second opening in communication with the rear acoustical chamber, and the acoustical duct is in communication with the front horn by means of the feedback duct.

2. A sound reproduction system as set forth in claim 1 in which the feedback duct has a narrow aspect ratio.

3. A sound reproduction system as set forth in claim 1 wherein feedback duct has a first opening that is in communication with the acoustical duct and a second opening that is in communication with the front horn path between them and wherein the characteristics of either the first or second opening or both can be varied.

4. A sound reproduction system as set forth in claim 1 wherein the acoustical duct is a ring resonator.

5. A sound reproduction system as set forth in claim 4 in which an aspect ratio of the feedback duct is selected so as to effect pressure losses between the front horn and rear chamber via the ring-resonator.

6. A sound reproduction system as set forth in claim 5 wherein the feedback duct is used to control phase-sensitive feedback in the sound reproduction system.

7. A sound reproduction system as set forth in claim 4 wherein the feedback duct connects the looped acoustical duct and the front horn serves to control, or regulate a pressure loss between the front horn resonator and the ring resonator or the rear chamber.

8. A sound reproduction system as set forth in claim 1 further comprising a housing for the sound reproduction system and wherein the acoustical duct is either internal or external to the housing.

9. A sound reproduction system as set forth in claim 1 wherein one or more of the front horn and the acoustical duct is folded.

10. A sound reproduction system as set forth in claim 1 wherein the front horn is wrapped around outside of the acoustical duct relative to the speaker driver.

11. A sound reproduction system as set forth in claim 1 wherein the front horn path is folded and lies on the interior of a boundary formed by the acoustical duct.

12. A sound reproduction system as set forth in claim 1 wherein the front horn and the looped acoustical duct have a separator wall which includes a topography that twists through 180 to form a Moebius strip.

13. A sound reproduction system as set forth in claim 1 which includes multiple looped acoustical ducts of variable or differing lengths.

14. A sound reproduction system as set forth in claim 1 which includes multiple feedback ducts of variable or differing lengths.

15. A sound reproduction system as set forth in claim 1 which has multiple speaker drivers.

16. A sound reproduction system as set forth in claim 1 wherein the sound reproduction system is used for one or more of systems for public speaking addresses; orchestral, dance and theatrical performances; rock, jazz or pop concerts; movie, surround sound or amusement park type experiences; places of worship; arena events such as sporting or skating; school presentations; and high fidelity home audio and home theater experiences.

17. A sound reproduction system as set forth in claim 1 which is one or more of a sub-bass woofer, bass woofer, mid-bass woofer, and mid-range speaker.

18. A sound reproduction system comprising one or more dynamic driver positioned between a front and a rear acoustical chamber, with the front chamber in communication with a front horn, and a ring resonator, and the rear acoustical chamber in communication with the ring-resonator to form a ring path, and the ring-resonator is in communication with the front horn via a feedback duct.

19. A sound reproduction system as set forth in claim 1 wherein the said feedback duct geometry is adjustable either in real-time or via rapidly reconfigurable feedback duct modules in order to effect and optimize the speaker for the different intended modes of operation.

20. A sound reproduction system as set forth in claim 1 wherein said path forms a ring.

21. A sound reproduction system as set forth in claim 20 wherein said ring is folded.

22. A method of increasing the performance of a speaker having a diaphragm producing a wave compression, the speaker in a sound reproduction system including a horn having a throat, comprising the steps of harnessing the back side production of the wave compression from the diaphragm looping it around in an open circuit by allowing the back side product to enter an acoustical duct from either of a first acoustical duct opening or a second acoustical duct opening; and feeding it into horn in front of the throat.

23. A method as set forth in claim 22 wherein the back side production is harnessed using a ring resonator.

24. A method as set forth in claim 23 wherein the ring resonator is in further communication with the front horn by means of a feedback duct.

25. A method as set forth in claim 24 wherein the feedback duct is used to control the phase recombination of the front and back of the speaker driver.

26. A method as set forth in claim 25 wherein the feedback duct acts as an integrator for the front and back of the speaker driver.

27. A method of increasing the performance of a speaker as set forth in claim 22 wherein said acoustical duct is folded.

28. A method of increasing the performance of a speaker as set forth in claim 27 wherein said acoustical duct is a ring.

29. A method of increasing the performance of a speaker as set forth in claim 22 wherein said acoustical duct is a ring.

30. A sound reproduction system comprising a front horn having an opening, a speaker driver having a speaker driver diaphragm, a front acoustical chamber in communication with the front horn, and a rear acoustical chamber, wherein the speaker driver diaphragm defines the boundary between the front acoustical chamber and the rear acoustical chamber, an acoustical duct in communication with itself through a first acoustical duct opening and a second acoustical duct opening, each connected to the rear chamber so as to form a ring, and a feed-back duct in communication with the front horn through the opening on the front horn and with and the acoustical duct through a feedback duct opening along the acoustical duct.

* * * * *